US006705402B2

(12) United States Patent
Proctor

(10) Patent No.: US 6,705,402 B2
(45) Date of Patent: Mar. 16, 2004

(54) GAS SEPARATING INTAKE FOR PROGRESSING CAVITY PUMPS

(75) Inventor: Bruce Erwin Proctor, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/123,997

(22) Filed: Apr. 17, 2002

(65) Prior Publication Data

US 2003/0196802 A1 Oct. 23, 2003

(51) Int. Cl.[7] ..... E21B 43/38

(52) U.S. Cl. ..... 166/369; 166/68.5; 166/105.5; 166/265

(58) Field of Search ..... 166/369, 265, 166/105.5, 68.5, 68, 66.4

(56) References Cited

U.S. PATENT DOCUMENTS 3,291,057 A 12/1966 Carle
4,913,630 A 4/1990 Cotherman et al.
5,015,162 A 5/1991 Heppner
5,113,937 A 5/1992 Cholet
5,207,810 A 5/1993 Sheth
5,525,146 A 6/1996 Straub
5,996,691 A * 12/1999 Norris et al. ..... 166/250.03
6,257,333 B1 7/2001 Mann et al.

* cited by examiner

*Primary Examiner*—Zakiya Walker
(74) *Attorney, Agent, or Firm*—Bracewell & Patterson, L.L.P.

(57) ABSTRACT

A downhole pump assembly is suspended by tubing in a well. The pump assembly has a separator attached below a progressing cavity pump with a flexible shaft to accommodate the concentric path of the shaft of the separator and the eccentric path of the rotor of the pump. Vanes on the shaft of the separator use centrifugal force to separate the heavier liquids from the lighter gases in the well fluids. The separator discharges the gas into the casing and the liquid to the pump. A motor drives both the separator and the pump. A gear reduction unit is located between the motor and the pump in order to reduce the rotational speed from the motor to the desired rotational speed of the rotor for the pump.

20 Claims, 4 Drawing Sheets

GAS SEPARATING INTAKE FOR PROGRESSING CAVITY PUMPS

BACKGROUND OF THE INVENTION

1. Field of the Invention

The invention relates generally to progressing cavity well pumps and in particular to separating the gas from the crude oil before pumping the oil up the well.

2. Description of the Related Art

When an oil well is initially completed, the downhole pressure may be sufficient to force the well fluid up the well tubing string to the surface. The downhole pressure in some wells decreases, and some form of artificial lift is required to get the well fluid to the surface. One form of artificial lift is suspending a centrifugal electric submersible pump (ESP) downhole in the tubing string. The ESP provides the extra lift necessary for the well fluid to reach the surface. An ESP has a large number of stages, each stage having an impellor and a diffuser. In gassy wells, or wells which produce gas along with oil, there is a tendency for the gas to enter the pump along with the well fluid. Gas in the pump decreases the volume of oil transported to the surface, which decreases the overall efficiency of the pump and reduces oil production. A gas separator may be mounted between the pump and motor to reduce gas entering into the pump. The gas separator rotates at the same speed as the pump and motor.

A progressive cavity pump is another type of well pump. A progressing cavity pump has a helical metal rotor that rotates inside a helical elastomeric stator. The liquid being pumped acts as a lubricator between the helical rotor and the stationary stator. If gas enters the pump, the gas may prevent the liquid from continuously lubricating the rotor and stator surfaces while flowing through the pump. The stator deteriorates quicker when there is not a thin layer of liquid on their surfaces acting as a lubricator. Quicker deterioration of the stator causes less time between maintenance and repairs of the pump.

Gas separators have not been used in conjunction with progressing cavity pumps, which operate at slower speeds than centrifugal pumps. Furthermore, the shaft in a rotary separator has a concentric or substantially circular path around the centerline of the shaft, while the rotor of a progressing cavity pump has an eccentric or elliptical path around the centerline of the rotor.

SUMMARY OF THE INVENTION

The downhole pump assembly in this invention has a progressing cavity downhole pump that is suspended by tubing in a well. The progressing cavity pump is a positive displacement pump. A cavity of liquid is forcibly pushed through the pump when a helical-shaped rotor rotates inside of the stator. A motor drives the rotor of the pump with a drive shaft. However the drive shaft from the motor typically rotates at a speed that is too fast for the rotor of the pump. A gear assembly between the motor and the pump transmits the rotations from the drive shaft to the pump rotor at a slower, operational speed of the pump.

A separator located below the pump separates the gas from liquids in the well fluid. The separator may have a helical inducer and a series of vanes rotated by a separator shaft inside of the separator housing, which in turn is driven by the motor. Alternatively, the separator may have a vortex chamber instead of vanes after the helical inducer. One end of the separator shaft is connected to the rotor of the pump.

The separator shaft travels in a concentric or substantially circular path around the centerline of the shaft, while the rotor of the pump travels in an eccentric or elliptical path around the centerline of the rotor. A flexible shaft connects the shaft of the separator to the rotor of the pump. The flexible shaft compensates for different paths of the rotor and the separator shaft.

An annular passageway is located in the area between the flexible shaft and a shroud or housing that encloses the flexible shaft. The annular passageway is in fluid communication with the liquid outlet from the separator and the liquid inlets of the pump. In the first embodiment, the separator is also located above the gear reduction unit. Therefore, in this embodiment, the vanes and helical inducer of the separator rotate at the same speed as the rotor of the pump.

After suspending the pump assembly in the well, power is supplied to the motor to rotate the separator shaft and the pump rotor. The gear reduction unit located below the separator decreases the rotational speeds of the separator shaft and the pump rotor from that of the drive shaft from the motor. Well fluids enter the separator through separator inlets at the lower portion of the separator. The well fluid flows into an optional rotating helical inducer, and delivers the fluids into the separator vanes. The rotating vanes use centrifugal forces to push the heavier liquids in the well fluid to the outermost portion of the separator while the lighter gases remain in the innermost portions of the separator.

The liquids on the outer portion of separator exit the vanes to a passage on the outer surface of a crossover lip. The gases exit the vanes to the inner surface of the crossover lip. The crossover communicates the separated gases to gas outlets on the exterior surface on the upper portion of the separator. The gases exit the separator and rise to the surface under normal gas-lift properties. The passageway on the outside of the crossover lip communicates the separated liquids to the separator outlets on the upper portion of the separator, above the gas outlets. The separator liquid outlets communicate with the annulus surrounding the flexible shaft inside of the housing. The annulus communicates the liquids the to inlets of the pump.

The liquids enter the progressing cavity pump into a cavity between the rotor and the stator. The cavity travels up the pump as the rotor rotates inside the stator. Most of the fluid travels with the cavity and exits out of the pump outlets on the upper portion of the pump into the tubing with an increased liquid pressure to lift the liquids to the surface. A thin layer of liquid typically remains on the surfaces of the rotor and the stator when the cavity carrying liquid passes through the pump. The thin layer of liquid acts as a lubricant between the rotor and the stator. The liquid continues to lubricate the rotor and stator surfaces during operation. Therefore, the stator does not deteriorate due to lack of lubrication.

In another embodiment, the gear reduction unit is located between the separator and the pump. In this embodiment, the shaft of the separator rotates at the same speed as the drive shaft from the motor, while the rotor of the pump still rotates at the slower pump speed. The shroud surrounding the flexible shaft between the pump and the separator also extends down around the gear reduction unit to a point below the pump liquid outlets. Liquid communicates from the pump outlets into an annular passage between the shroud and the gear reduction unit to the annulus between the shroud and the flexible shaft to the pump inlets. This embodiment is good for situations in which the separator needs to operate at a faster speed in order to separate the gas from the liquids in the well fluid.

In the third embodiment, a motor on the surface at the upper end of the well drives the pump and separator. The drive shaft from the motor has a drive member extending down the well to the rotor of the pump. The separator is connected to the pump by a flexible shaft enclosed in a housing, as in the first embodiment. The separator is also driven by the motor located on the surface. The separator shaft is rotating at the same speed as the rotor of the pump.

In all three of these embodiments, gas in the well fluid is separated from the liquid before the liquids enter the pump. These embodiments increase the amount of time between repairs of the rotor and stator of the pump because the pump is continuously lubricated.

DESCRIPTION OF THE PREFERRED EMBODIMENTS

Figure 1A:
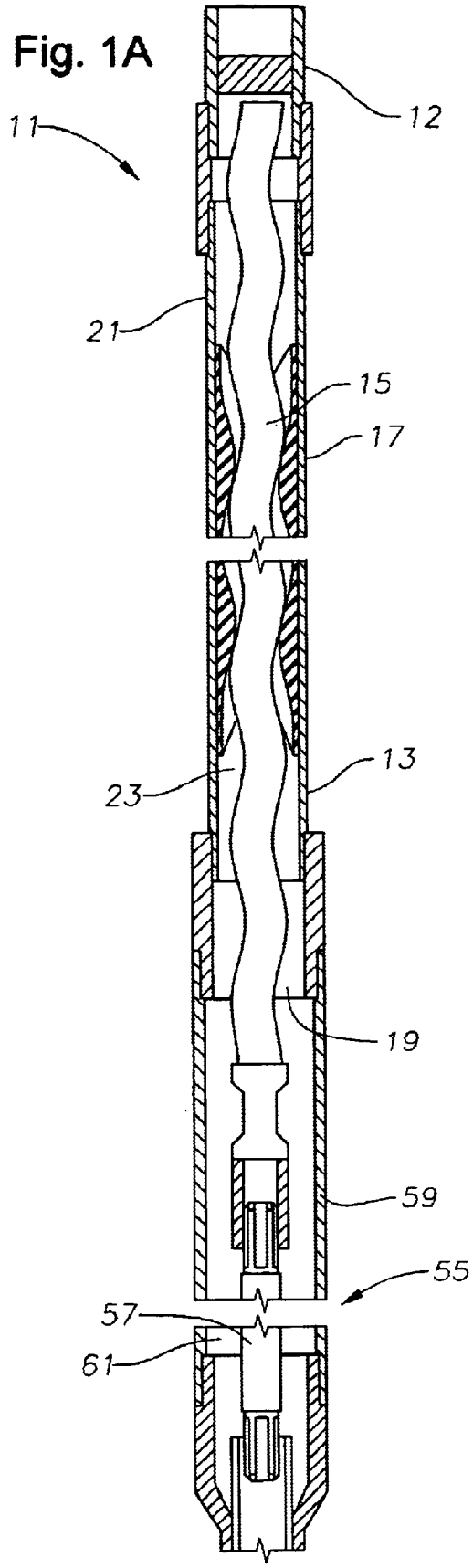
FIGS. 1A and 1B comprise a cross-sectional view of a downhole pump assembly constructed in accordance with this invention.
Figure 1B:
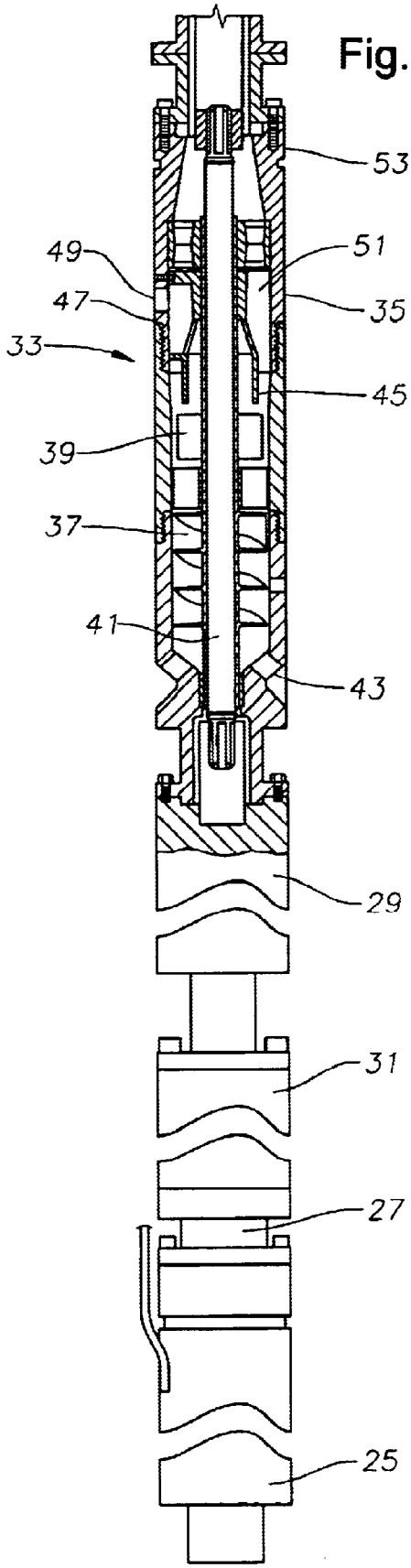

A downhole pump assembly 11 is shown in FIG. 1. Pump assembly 11 is suspended from tubing 12 in a well in order to pump well fluid to the surface when ordinary gas-lift forces are not enough produce the oil and gas from the well. Pump assembly 11 has a progressing cavity pump 13. Progressing cavity pump 13 has a rotor 15 having a helical shape that rotates within an elastomeric stator 17. An inlet 19 is located at the lower portion of progressing pump 13 where liquids enter pump 13. An outlet 21 is located at the upper portion of progressing cavity pump 13 for discharging the liquids up the string of tubing.

Liquids entering pump 13 flow into a double helical cavity 23 between rotor 15 and stator 17. Rotor 15 rotates so that the helical shape of rotor 15 and stator 17 force liquid to travel up pump 13. The liquid in cavity 23 is forcibly moved as portions of cavity 23 rise along rotor 15 to outlet 21, where the liquid is discharged above pump 13 into the string of tubing 12 leading to the surface. The liquid leaves a thin layer of liquid on the surfaces of rotor 15 and stator 17 as the liquid in cavity 23 travels up rotor 15 through pump 13. The thin layer of liquid left on the surfaces of rotor 15 and stator 17 acts as a lubricant, increasing the operational lifespan of rotor 15 and stator 17.

A motor 25 rotates rotor 15 from below pump 13. A multi-piece drive shaft 27 extends up from motor 25 in order to drive rotor 15 of pump 13. A seal section 29 is located above motor 25 around the circumference of shaft 27 to equalize the pressure of the lubricant inside of motor 25 with the hydrostatic pressure in the well. A gear reduction unit 31 is located between motor 25 and pump 13. Gear reduction unit 31 reduces the rotational speed of rotor 15 because pump 13 operates at a slower rotational speed than motor 25.

A separator 33 for separating the gas from the liquids in the well fluid is located below pump 13, between pump 13 and motor 25. Separator 33 preferably has a housing 35 enclosing a helical inducer 37 and a plurality of vanes 39 axially mounted on a separator shaft 41. Alternatively, separator 33 could have an empty chamber or vortex chamber (not shown) instead of vanes 39, where the gases can separate from the liquids after being discharged from helical inducer 37. The lower end of shaft 41 is connected to drive shaft 27 extending up from the motor 25, and the upper end of shaft 41 extends towards pump 13. A set of inlets 43 located at the lower portion of separator 33, allow the well fluid from the well to enter separator 33. Motor 25 rotates shaft 41, which in turn rotates helical inducer 37 and vanes 39. Well fluids entering separator 33 through inlets 43 flow to helical inducer 37. Helical inducer 37 forces the well fluid upward to vanes 39. The rotation of vanes 39 applies a centrifugal force to the well fluid, which causes the heavier liquids to flow to the outermost radial portions of separator 33 while the lighter gases remain in the innermost radial portions of separator 33.

A crossover lip 45 located above vanes 39 acts as a physical barrier preventing the liquids and gases from recombining after exiting from vanes 39. The heavier liquids exit vanes 39 and travel up separator 33 along the outside surface of crossover lip 45, and the lighter gases travel up the inside surface of crossover lip 45. Crossover 47 leads the lighter gases to gas outlet 49 located on the exterior surface on the upper portion of separator 33. The lighter gases communicate through crossover 47 to gas outlet 49, where the separated gases discharge into the annulus surrounding tubing 12 to rise to the surface under normal gas-lift properties. A passageway 51 defined by the exterior surface of crossover lip 45 and the interior surface of housing 35 receives the liquids separated from the well fluid by vanes 39. The liquids flow through passageway 51 to outlet 53 located in the upper portion of separator 33, which discharges the liquids towards pump 13.

In this embodiment, separator 33 is above gear reduction unit 31. Therefore, shaft 41 of separator 33 rotates at the same rotational speed as rotor 15 of progressing cavity pump 13. A flexible shaft assembly 55 is located between pump 13 and separator 33 and connects rotor 15 to shaft 41. Flexible shaft assembly 55 is needed because rotor 15 of pump 13 has an eccentric rotation while shaft 41 of separator 33 has a concentric rotation. Preferably, flexible shaft 57 is coupled to rotor 15 and shaft 41 by vertical spline or threaded couplings. Threaded and or vertically splined couplings allow each end of shaft 57 to orbit in unison with rotor 15 or shaft 41. The eccentric rotation of rotor 15 means that rotor 15 travels in an elliptical path about the centerline of rotor 15 as it rotates. The concentric rotation of shaft 41 means that shaft 41 rotates in a substantially circular path about the centerline of shaft 41. Flexible shaft assembly 55 has a flexible shaft 57 with the lower end connected to shaft 41 and the upper end connected to rotor 15. Flexible shaft 57 is preferably made of a steel, however its length allows flexing to compensate for the different paths the centerlines of rotor 15 and shaft 41 travel when rotated.

A housing or shroud 59 encloses flexible shaft assembly 55, defining an annulus 61 between the exterior surface of flexible shaft 57 and the interior surface of shroud 59. Annulus 61 is in fluid communication with separator liquid outlet 53 and pump inlet 19. Separator 33 discharges liquids separated from separator 33 through outlets 53 into annulus 61, where the liquids travel up annulus 61 alongside flexible shaft 57 into pump 13 through inlets 19.

In operation, downhole pump assembly 11 is lowered on tubing 12 into casing (not shown) in the well. Power is supplied to motor 25. Motor 25 rotates drive shaft 27, which in turn drives separator shaft 41 and rotor 15. Gear reduction unit 31 decreases the rotational speed between drive shaft 27 and separator shaft 41. Separator shaft 41 rotates helical inducer 37 and vanes 39. Well fluid enters separator 33 through inlets 43. Vanes 39 force the heavier liquids to the outermost portions of the inside of separator 33 and the lighter gases to inner portions of separator 33. Crossover lip 45 provides a physical barrier preventing the separated liquids and gases from recombining after exiting vanes 39.

Crossover 47 communicates the lighter gases from the inner portions of separator 33 to gas outlet 49. The separated gases discharge into the annulus surrounding tubing 12, where the gases will rise to the surface. The liquids flow along passageway 51 along the exterior of crossover lip 45 to separator outlet 53, where the liquids discharge into annulus 61. The liquids flow in annulus 61 between flexible shaft 57 and shroud 59 to pump inlet 19. Separator shaft 41 communicates the reduced speed rotation from drive shaft 27 to rotor 15. Flexible shaft 57 compensates for the different paths of the centerlines of pump rotor 15 and separator shaft 41.

Liquids entering progressing cavity pump 13 through inlet 19 enter cavity 23 between rotor 15 and stator 17. The rotation of rotor 15 causes cavity 23 to travel up pump 13 as helical rotor 15 rotates within stators 17. The pressure on the liquids increases and the liquids discharge into tubing 12 to flow to the surface.

As the liquids travel along rotor 15 and past stator 17, the liquids continually provide lubrication to the surfaces of rotor 15 and stators 17. The reduction of gases in the fluid pumped by progressing cavity pump 13 reduces the chance for rotor 15 to rub against dry, non-lubricated stator 17. Pump 13 can operate for longer periods of time because the lubricated surfaces will not deteriorate as quickly as surfaces constantly rubbing against each other without lubrication. Accordingly, pump assembly 11 as described above separates the gases from the well fluid in a manner that increases the time between repairs of pump 13. Increasing the time period between repairs is an improvement which increases the production capabilities of the well.

Figure 2A:
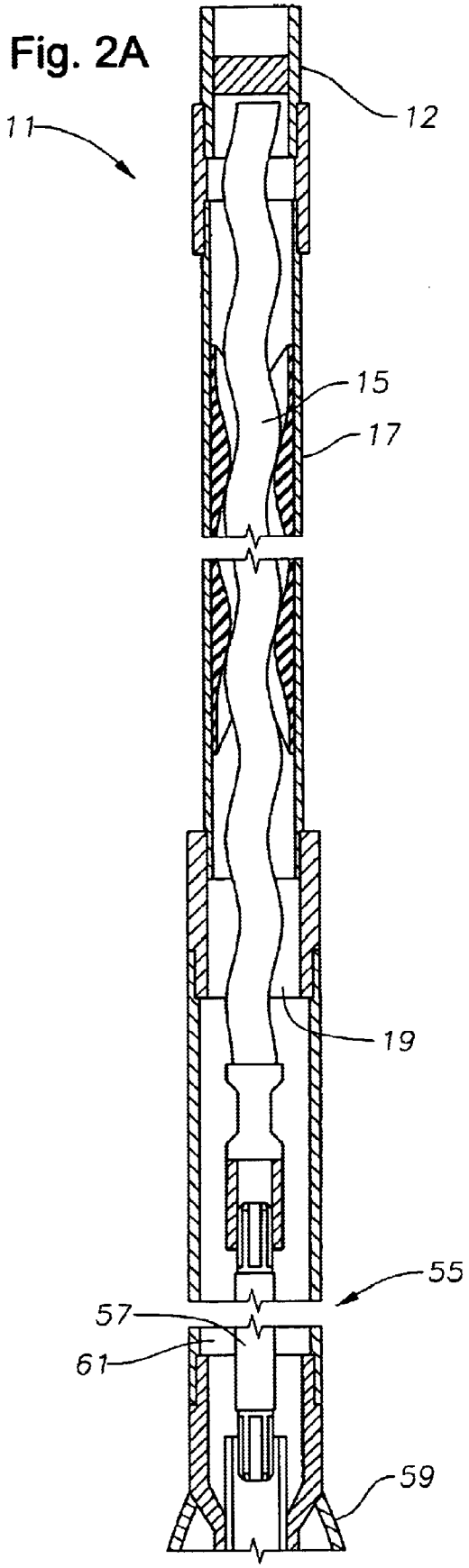
FIGS. 2A and 2B comprise a cross-sectional view of an alternative embodiment of a pump assembly constructed in accordance with the present invention, in which the gear reduction unit between the pump and separator.
Figure 2B:
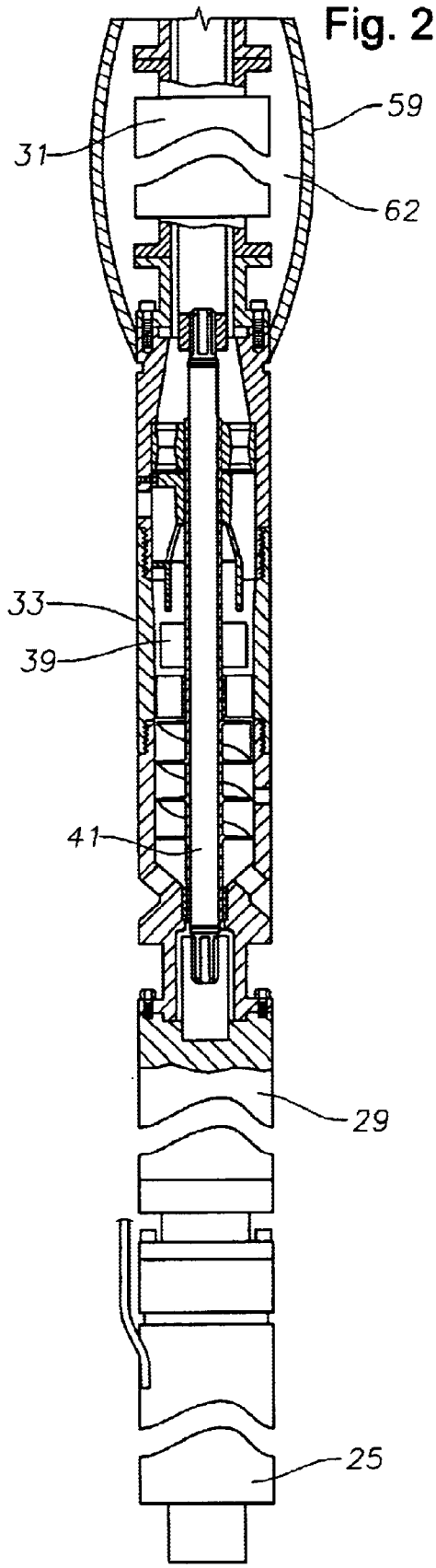

Referring to FIG. 2, a second embodiment of downhole pump assembly 11 is shown. In this embodiment, motor 25 and seal section 29 are located below pump 13 and separator 33 as before. Gear reduction unit 31 is located in a different location, between pump 13 and separator 33. In this embodiment, motor 25 rotates drive shaft 27, which in turn rotates separator shaft 41. Separator shaft 41 rotates at the same rotational speed as drive shaft 27 from motor 25. The gas is separated from the well fluids in separator 33 in the same manner as in the first embodiment.

Gear reduction unit 31 connects separator shaft 41 with flexible shaft 57, which is connected to rotor 15 on its other end. Gear reduction unit 31 decreases the speed of rotation of separator shaft 41 to the slower speed pump 13 needs rotor 15 to rotate. Accordingly, in this embodiment, separator 33 is operating at a higher rotational speed than pump 13.

In this embodiment, shroud 59 extends downward and also encloses gear reduction unit 31, defining a lower annular area 62 between the interior surface of shroud 59 and the exterior surface of gear reduction unit 31. Lower annulus 62 is in fluid communication with annulus 61. Separator outlet 53 discharges the separated liquids into lower annulus 62 and the liquids travel up lower annulus 62 past gear reduction unit 31 to annulus 61. In an embodiment not shown in FIG. 2, the outlet of separator 33 is in fluid communication with annulus 61 via tubing. In this alternative embodiment not shown in FIG. 2, the liquids can communicate from separator 33 to annulus 61 in shroud 59 with tubing traveling around gear reduction unit 31.

The liquids travel in annulus 61 between shroud 59 and flexible shaft 57 to pump inlets 19, where the liquids are pumped to the surface using pump 13 as described in the first embodiment. This embodiment is preferable in conditions in which the separator 33 needs to operate at faster speeds in order for vanes 39 to create large enough centrifugal forces to separate the gases from the liquids in the well fluid. Like the first embodiment, the reduction of gas entering pump 13 allows the separated liquids to lubricate rotor 15 and stator 17 while traveling through pump 13.

Figure 3A:
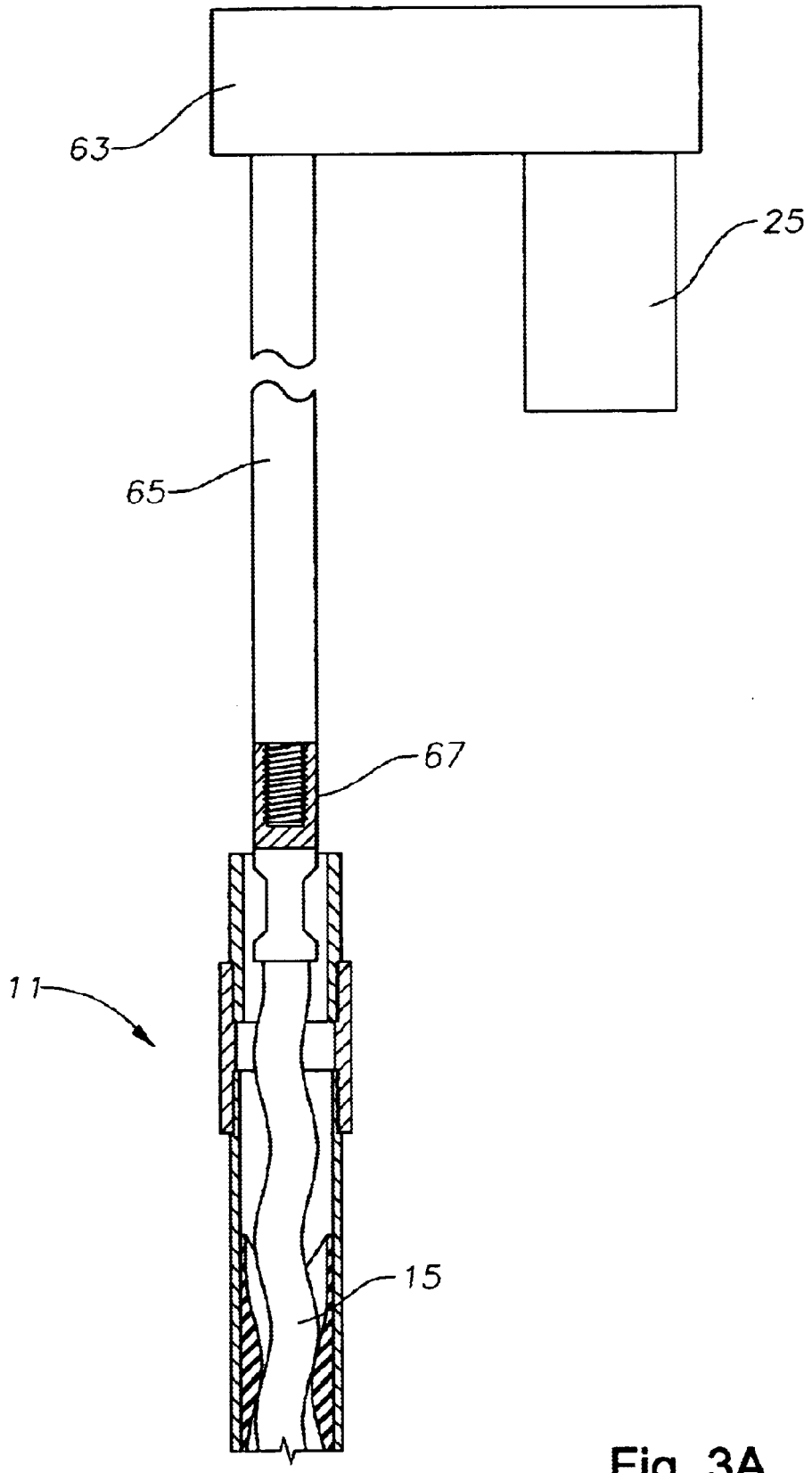
FIGS. 3A–3C comprise a cross-sectional view of an alternative embodiment of a pump assembly constructed in accordance with the present invention, in which the motor is at the surface.
Figure 3B:
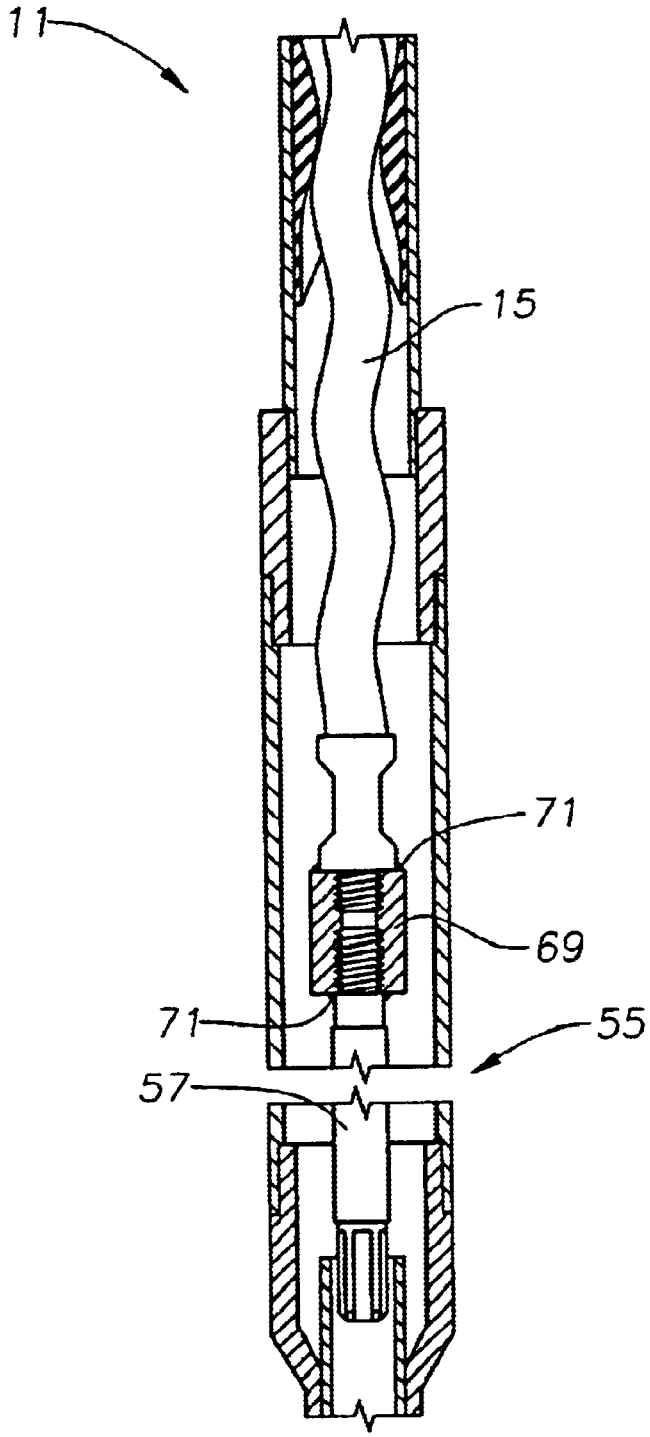
Figure 3C:
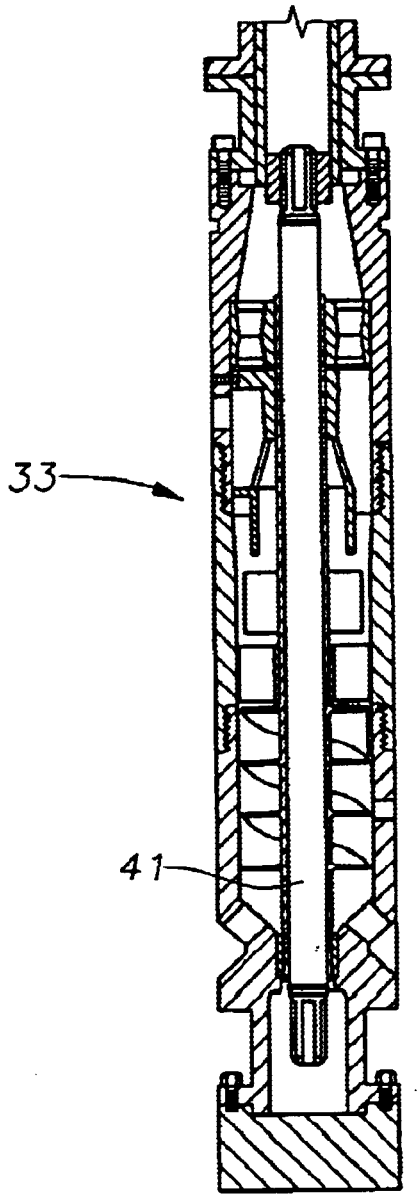

Referring to FIG. 3, a third embodiment of downhole pump assembly 11 is shown. In this embodiment, motor 25 is located above separator 33 and pump 13 at the surface or upper end of the well. Right angle gear reduction or belt drive unit 63 is located directly above the well. Gear reduction or belt drive unit 63 has a second shaft or rod 65 extending down into the well that drives pump 13. Unit 63 also decreases the rotational speed of shaft 65 relative to motor drive shaft 27.

Coupling 67 connects shaft 65 to the upper end of rotor 15 above pump 13. Preferably, coupling 67 is a threaded coupling. In this embodiment, a coupling 69 connects the lower end of rotor 15 to flexible shaft 57. Preferably, coupling 69 is a threaded coupling which prevents longitudinal movement of the rotor relative to the pump at coupling 69. Welds 71 can further secure flexible shaft 57 and rotor 15 to coupling 69 after being threadedly coupled. However, coupling 67 could be a vertical spline coupling with a fastener extending through the coupling and the portion of flexible shaft 57 coupling 69 receives. Rotor 15 rotates flexible shaft 57 in flexible shaft assembly 55 and separator shaft 41 below pump 13. Because gear reduction or belt drive unit 63 is located between motor 25 and pump 13, separator shaft 41 rotates at the same rotational speed as pump rotor 15.

Further, it will also be apparent to those skilled in the art that modifications, changes and substitutions may be made to the invention in the foregoing disclosure. Accordingly, it is appropriate that the appended claims be construed broadly and in the manner consisting with the spirit and scope of the invention herein.

What is claimed is:

1. A system for pumping fluid from a well, comprising:

a downhole progressing cavity pump having a helical rotor;

a downhole gas separator located below the pump and having a rotatable vane for separating gas from liquid well fluid and delivering the liquid well fluid to the pump;

a motor for supplying power to drive the rotor of the pump and rotate the vane of the gas separator; and a speed reduction unit between the motor and the pump, which reduces the speed that the rotor rotates within the pump to less than the speed of the motor.

2. The system of claim 1, wherein the separator has an inlet at a lower end of the separator.

3. The system of claim 1, wherein the motor is located below the pump and the separator, and the speed reduction unit is positioned between the motor and the separator, causing the vane of the separator and the rotor to rotate at the same speed, which is less than the motor speed.

4. The system of claim 1, wherein the motor is located below the pump and the separator, and the speed reduction unit is positioned between the separator and the pump, which reduces the speed the rotor rotates within the pump to less than the speed of the motor and the vane within the separator.

5. The system of claim 1, wherein the motor and the speed reduction unit are located above the pump at the upper end of the well for driving the rotor of the pump and the vane of the separator at the same speed with a rod extending down the well to the upper end of the rotor.

6. The system of claim 1, wherein the speed reduction unit is positioned between the motor and the separator, causing the rotor of the pump and the vane of the separator to rotate at the same speed, which is less than the motor speed.

7. The system according to claim 1, wherein the separator has an inlet that inclines upwardly and inwardly from an exterior of the separator to an interior of the separator.

8. The system of claim 1, wherein:

the motor is located below the pump and the separator;

the speed reduction unit is positioned between the separator and the pump, which reduces the speed the rotor rotates within the pump to less than the speed of the vane within the separator; and a conduit extends from a liquid well fluid outlet of the separator around the speed reduction unit and into an intake of the pump.

9. The system of claim 1, wherein:

the motor is located below the pump and the separator;

the speed reduction unit is positioned between the separator and the pump, which reduces the speed the rotor rotates within the pump to less than the speed of the vane within the separator; and a shroud extends from a liquid well fluid outlet of the separator, surrounds the speed reduction unit, and leads into an intake of the pump.

10. A system for pumping fluids, comprising:

a downhole progressing cavity pump, adapted to be suspended on a string of tubing, and having a helical rotor rotated inside a stationary stator;

a downhole separator located below the pump, having a housing and a vane that is rotatable within the housing;

a downhole motor having a drive shaft extending therefrom for rotating the rotor of the pump and the vane of the gas separator;

a flexible shaft assembly located between the rotor of the pump and the motor, allowing for elliptical movements of a the rotor of the pump; and a gear reduction unit located between the motor and the rotor, which makes the rotational speed of the rotor less than the rotational speed of the drive shaft of the motor.

11. The system of claim 10, wherein the gear reduction unit is located between the motor and the gas separator, causing the gas separator vane to rotate at the same speed as the rotor of the pump.

12. The system of claim 10, wherein the gear reduction unit is located between the gas separator and the rotor of the pump, causing the gas separator vane to rotate at a faster speed than the rotor of the pump.

13. The system of claim 10, further comprising a helical inducer rotated in the housing of the separator below the vane.

14. The system according to claim 10, wherein the separator has an inlet that inclines upwardly and inwardly from an exterior of the separator to an interior of the separator.

15. The system of claim 10, wherein:

the gear reduction unit is located between the gas separator and the rotor of the pump, causing the gas separator vane to rotate at a faster speed than the rotor of the pump; and a conduit extends from a liquid well fluid outlet of the separator around the gear reduction unit to an intake of the pump.

16. The system of claim 10, wherein:

the gear reduction unit is located between the gas separator and the rotor of the pump, causing the gas separator vane to rotate at a faster speed than the rotor of the pump; and a shroud extends from a liquid well fluid outlet of the separator, surrounds the gear reduction unit, and leads to an intake of the pump.

17. A method for pumping well fluids comprising:

(a) securing a gas separator having a rotary vane to a progressing cavity pump, and suspending the progressing cavity pump and gas separator in a well;

(b) connecting a motor and a speed reduction unit to the pump and the separator;

(c) supplying power to the motor to rotate a rotor of the progressing cavity pump at a lesser speed than the motor and to rotate the vane of the separator;

(d) separating gas from liquid of the well fluid in the gas separator;

(e) flowing the liquids separated from the gas in the well fluid into the progressing cavity pump; then (f) pumping the liquids to the surface with the progressing cavity pump.

18. The method of claim 17, wherein step (b) comprises positioning the speed reduction unit between the separator and the pump and step (c) comprises rotating the vane of the separator at a higher speed than the rotor of the pump.

19. The method according to claim 18, wherein step (e) comprises flowing the liquids separated by the separator around the speed reduction unit and into an intake of the pump.

20. The method according to claim 17, wherein step (b) comprises positioning the speed reduction unit between the motor and the separator and step (c) comprises rotating the vane of the separator at the same speed as the rotor of the pump.

* * * * *